US006361310B1

(12) United States Patent
Fastnacht et al.

(10) Patent No.: US 6,361,310 B1
(45) Date of Patent: Mar. 26, 2002

(54) METHOD AND APPARATUS FOR OPERATING A COMBUSTION PLANT

(75) Inventors: Felix Fastnacht; Thomas Merklein, both of Erlangen (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/630,152

(22) Filed: Jul. 31, 2000

Related U.S. Application Data

(63) Continuation of application No. PCT/DE99/00248, filed on Jan. 29, 1999.

(30) Foreign Application Priority Data

Jan. 30, 1998 (DE) ..... 198 03 715

(51) Int. Cl.[7] ..... F23N 5/08
(52) U.S. Cl. ..... 431/12; 431/75
(58) Field of Search ..... 431/2, 12, 75, 431/76, 89, 90, 174; 250/339.15; 340/578; 110/185, 186, 187, 188, 190, 191

(56) References Cited

U.S. PATENT DOCUMENTS

| | | | | |
|---|---|---|---|---|
| 3,292,855 A | * | 12/1966 | Wright | 431/12 |
| 4,059,385 A | * | 11/1977 | Gulitz et al. | 431/12 |
| 4,622,922 A | | 11/1986 | Miyagaki et al. | |
| 4,887,958 A | * | 12/1989 | Hagar | 431/76 |
| 4,913,647 A | * | 4/1990 | Bonne et al. | 431/12 |
| 4,969,408 A | | 11/1990 | Archer et al. | |
| 5,551,780 A | | 9/1996 | Wintrich et al. | |
| 5,755,819 A | * | 5/1998 | Bonanni et al. | 431/2 |
| 5,794,549 A | * | 8/1998 | Carter | 110/185 |

FOREIGN PATENT DOCUMENTS

| | | | | |
|---|---|---|---|---|
| DE | 80 17 259.4 | | 4/1983 | |
| DE | 195 09 412 A1 | | 10/1996 | |
| DE | 197 10 206 A1 | | 9/1998 | |
| EP | 0 612 961 A2 | | 8/1994 | |
| JP | 63-21730 | | 9/1988 | |
| JP | 63-217130 A | * | 9/1988 | 431/76 |

* cited by examiner

*Primary Examiner*—Sara Clarke
(74) *Attorney, Agent, or Firm*—Herbert L. Lerner; Laurence A. Greenberg; Werner H. Stemer

(57) ABSTRACT

A method of operating a combustion plant having a number of burners includes controlling a composition of a fuel mixture of each burner with at least one setpoint that is determined with reference to dynamic characteristic quantities characterizing a combustion process, and determining the at least one setpoint in dependence on a contribution of each individual burner to a total proportion of a reaction product produced in the combustion process. The contribution of each burner to the total proportion of the reaction product is determined for each burner with reference to the dynamic characteristic quantities and static characteristic quantities characterizing a combustion plant. The method homogenizes the combustion process. The invention also includes an apparatus applying the method, including burners respectively controlled with the setpoint for a composition of a fuel mixture. A setpoint module determines the setpoint for each individual burner of the burners. At least one combustion analysis module is provided for processing the dynamic characteristic quantities and static combustion quantities characterizing a combustion plant. The combustion analysis module is preferably connected upstream of the setpoint module in a signal flow direction in order to determine the contribution of each individual burner.

20 Claims, 2 Drawing Sheets

METHOD AND APPARATUS FOR OPERATING A COMBUSTION PLANT

CROSS-REFERENCE TO RELATED APPLICATION

This application is a continuation of copending International Application No. PCT/DE99/00248, filed Jan. 29, 1999, which designated the United States.

BACKGROUND OF THE INVENTION

Field of the Invention

The invention lies in the field of combustion plants. The invention relates to a method of operating a combustion plant. It also relates to an apparatus for carrying out the method.

For the combustion of a fossil fuel in a combustion space, efforts are focused on constantly improving the combustion process. A suitable firing control is normally provided to achieve an especially good combustion process with as low an emission of pollutants as possible, in particular, CO and NOx, with an especially high efficiency and, at the same time, with a low volumetric flow of flue gas. In such a firing control, the concentration of at least one reaction product produced in the combustion process is usually determined.

During the combustion of fossil fuel or garbage, fluctuations in the calorific value of the fuel or of the fuel mixture may occur, particularly when the fuel has different origins or the garbage has a heterogeneous composition. These fluctuations adversely effect the pollutant emission. The disadvantages also exist during the industrial combustion of residues, during which solid and liquid, as well as gaseous, fuels are usually burned at the same time. If the temperature distribution and the concentration profile of reaction products arising in the combustion process are known, an improvement in the firing control, and, thus, an improvement in the combustion process with regard to low pollutant emissions, can be achieved.

German Utility Model 197 10 206.9 having the title Method and apparatus for analyzing the combustion and monitoring the flame in a combustion space, describes a method in which the temperature distribution and the concentration distribution of a reaction product (produced in the combustion process) in a flame are determined with an optical system. With such a method, the changes in the concentration distribution of the reaction product to be tested can also be determined locally in the combustion space, particularly in a flame. However, only global effects of the combustion process enter the firing control. Thus, efficiency in the case of locally determined distributions is only limited.

In addition, German Utility Model DE 80 17 259.4 41 discloses a firing plant for the controlled combustion of solid fossil fuels. In the firing plant, a plurality of radiation sensors is assigned to the flame region of each individual burner of the firing plant. Control of the individual burners is made possible with reference to the radiation intensity determined for each individual burner. A disadvantage of the plant is that the radiation intensity of an individual flame is determined by a plurality of radiation sensors respectively recording a line of the flame. To record a section of the flame, the radiation sensors are pivotably disposed. Such a configuration is especially time-intensive and complicated. In particular, for a heterogeneous temperature distribution, which normally characterizes the combustion process of a combustion plant configured as a garbage incineration plant, the resulting different local densities of combustion gases are not taken into account in the firing control. Therefore, the influence of the firing control with regard to an especially low pollutant emission is slight.

SUMMARY OF THE INVENTION

It is accordingly an object of the invention to provide a method and apparatus for operating a combustion plant that overcomes the hereinafore-mentioned disadvantages of the heretofore-known methods and devices of this general type and that sets the combustion process for an especially low pollutant discharge simply and quickly.

With the foregoing and other objects in view, there is provided, in accordance with the invention, a method of operating a combustion plant having a number of burners, the composition of the fuel mixture of each burner being controlled by at least one setpoint determined with reference to dynamic characteristic quantities characterizing the combustion process. In the method, the setpoint for each individual burner is determined as a function of or independence on its contribution to the total proportion of a reaction product produced in the combustion process, in which case, the contribution of each burner to the reaction product is determined for each burner with reference to the dynamic characteristic quantities and static characteristic quantities characterizing the combustion plant.

The invention is based on the idea that global measured values are not sufficient for an especially simple and quick setting of an especially low pollutant discharge. On the contrary, the individual contribution of each burner should be determined and taken into account in the firing control. The determination of the contribution of an individual burner to the concentration quantity of a reaction product produced in the combustion process, in particular, at the outlet of the combustion space, enables the effect of each individual burner with regard to the total contribution to the pollutant emission to be taken into account. Thus, the combustion behavior of an individual burner and its effect on the combustion process can be optimized.

In accordance with another mode of the invention, the determining step is performed by determining the contribution of each burner to the reaction product using spatial resolution.

The local progress of at least one reaction product to be tested, e.g., of a combustion radical or a flue-gas quantity CO or NOx inside the combustion space, up to the outlet of the combustion space is advantageously calculated for each individual burner. The contribution of the burner or of each burner to the reaction product is expediently determined in a spatially resolved manner. In dependence on the contribution of the relevant burner to the concentration quantity of the reaction product, at least one setpoint for the composition of the fuel mixture of this burner is determined. By tracing the respective contribution to the total proportion of the reaction product to be tested in the combustion space, the entire combustion is homogenized and improved by optimizing the individual burners.

In accordance with a further mode of the invention, at least one of the dynamic and static characteristic quantities is processed with a combustion model of the combustion process.

In an especially advantageous manner, the combustion model simulates the combustion process. The combustion model describes the combustion process with reference to the chemical reaction kinetics with suitable differential formulations. The transport processes are described, for example, with reference to the diffusion, the mass flow, and/or the heat flow. The chemical reactions in the combustion space or in the flame, e.g., the oxidation, are described with reference to elementary reactions taking place during the combustion. The physical couplings between the transport processes or material flows of the individual burners and between components of the combustion space, e.g., heat flow between the burner and the wall of the combustion space, are taken into account in the combustion model by the exchanged heat flow, the convection, and/or the radiation.

In accordance with an added mode of the invention, the processing step is performed by simulating chemical reaction kinetics with the combustion model of the combustion process.

In an expedient development, at least some of the characteristic quantities, in particular the dynamic characteristic quantities, are determined with the aid of measurements. For example, the concentration of the reaction product is reconstructed in a computer-tomographic manner from an emission spectrum recorded in the combustion process. In addition, at least some of the characteristic quantities are advantageously output from a memory as filed characteristic quantities. The individual phases of the combustion process can be simulated with these filed characteristic quantities, in which case, by changes in individual characteristic quantities, e.g., the addition of oxygen for $O_2$ enrichment, the combustion process can be optimized with regard to an especially low pollutant emission.

In accordance with yet another mode of the invention, at least some of the dynamic characteristic quantities are output from a memory as filed characteristic quantities.

Characteristic quantities are fed as input quantities to the combustion model. Preferably used as characteristic quantities of the combustion process are: (1) the value of the concentration of the reaction product to be tested, e.g., of the combustion radical Co or CH in the flame of the selected burner; (2) the fuel quantity or fuel feed of the selected burner; (3) the air feed or fed air quantity of the selected burner; and/or (4) at least one alternating quantity of components that are in heat exchange with this burner, e.g., other burners or the wall of the combustion space. The characteristic quantities characterizing the combustion process are dynamic characteristic quantities that are characterized by the respectively associated instantaneous values for a time domain.

In accordance with yet an added mode of the invention, the static characteristic quantities of the combustion plant include at least one of a number of burners used and at least one geometric quantity of a combustion space.

At least one geometric quantity of the combustion space and/or the number of burners used are preferably used as characteristic quantities of the combustion process. These are also called boiler quantities. The characteristic quantities of the combustion plant are static characteristic quantities that describe the combustion plant with respect to the construction and the geometry.

In accordance with yet an additional mode of the invention, at least one of the static and the dynamic characteristic quantities are processed with a combustion model of the combustion process to form an output quantity characterizing an individual/respective burner.

In order to determine the contribution of the individual burner to the reaction product in the combustion space at a preselected location, the characteristic quantities of the burner to be tested are processed with the combustion model to form an output quantity characterizing the burner, e.g., to form a concentration value of a combustion radical to be tested at the outlet of the combustion plant. The output quantity of the burner is then expediently compared with the weighted average value of the output quantities of the other burners. From the comparison, it is already possible to infer a possible malfunction of the respective burner.

The resulting comparison value is preferably used for forming at least one of the setpoints for the composition of the fuel mixture of the relevant burner. With reference to the comparison of the contribution of the individual burner with the total sum of the contributions of all the burners and the setpoint formed therefrom, the combustion behavior of the relevant burner is homogenized and optimized with regard to the entire combustion in an especially advantageous manner.

With the objects of the invention in view, there is also provided an apparatus for operating a combustion plant having a number of burners. The burners are respectively controlled with at least one setpoint for a composition of a fuel mixture, the at least one setpoint being determined with reference to dynamic characteristic quantities characterizing a combustion process. The apparatus has a setpoint module for determining the setpoint for the composition of the fuel mixture of each individual burner in dependence on its contribution to the total proportion of a reaction product produced in the combustion process. The apparatus also has a combustion analysis module for processing the dynamic characteristic quantities and static characteristic quantities characterizing the combustion plant. The combustion analysis module is connected upstream of the setpoint module in a signal flow direction in order to determine the contribution of each individual burner. The combustion model is expediently stored in the combustion analysis module.

In accordance with again a further feature of the invention, there is provided a data processing module for determining the dynamic characteristic quantities of each burner of the burners. The data processing module is connected to the combustion analysis module for processing the dynamic characteristic quantities. Preferably, the data processing module is connected upstream of the combustion analysis module in a signal flow direction.

In accordance with again an added feature of the invention, the combustion analysis module is two combustion analysis modules and including a data module for filed dynamic characteristic quantities, the data module being connected upstream of at least one of the two combustion analysis modules in a signal flow direction.

In accordance with again an additional feature of the invention, the data module is connected upstream of a second of the two combustion analysis modules in a signal flow direction.

In accordance with still another feature of the invention, the static characteristic quantities fed to the combustion analysis module are expediently stored in a data memory. The combustion behavior of the individual burner or of a combination of a plurality of burners can be simulated in an especially advantageous manner with the characteristic quantities filed in the data module and in the data memory and the resulting flue-gas values. The stored characteristic quantities are varied by small amounts and are processed with the above-described combustion model until a predeterminable flue-gas value or value of the reaction product is set. With reference to the value determined, which, for example, represents an especially low emission of the reaction product, setpoints of the individual burners with regard to the composition of the respective fuel mixture are then set.

To homogenize the combustion behavior of the individual burner, the combustion analysis module is preferably connected to the setpoint module, on one hand, directly and, on the other hand, with an averaging module and/or a weighting module in between. Therefore, a setpoint, determined by the setpoint module, for the composition of the fuel mixture of the relevant burner can be determined in dependence on the other burners participating in the combustion process. The setpoint module can set the combustion behavior of each burner. Therefore, an especially low pollutant emission is achieved by such a specific control of each burner.

In accordance with still a further feature of the invention, the at least one combustion analysis module has a combustion model.

In accordance with a concomitant feature of the invention, there is provided at least one of an averaging module and a weighting module, and the setpoint module is connected to the at least one combustion analysis module with the at least one of the averaging module and the weighting module in between. The averaging is preferably disposed upstream of the weighting module in a signal flow direction.

Advantages achieved with the invention, in particular, include the fact that, by determining the contribution of an individual burner to the total value of a reaction product to be tested, e.g. of a flue-gas quantity, the operating mode of each individual burner can be set to improve the entire combustion with regard to an especially low pollutant emission. A uniform combustion behavior of all the burners is permitted, in particular, by the burner-resolved determination of the respective flue-gas values of all the burners at the outlet of the combustion plant and by the subsequent mutual optimization of the burners. The processing speed for the combustion module is especially high due to the fact that the entire combustion is split up among the individual burners. Therefore, the method together with the apparatus is suitable for controlling a combustion plant in real time.

Other features that are considered as characteristic for the invention are set forth in the appended claims.

Although the invention is illustrated and described herein as embodied in a method and apparatus for operating a combustion plant, it is, nevertheless, not intended to be limited to the details shown since various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
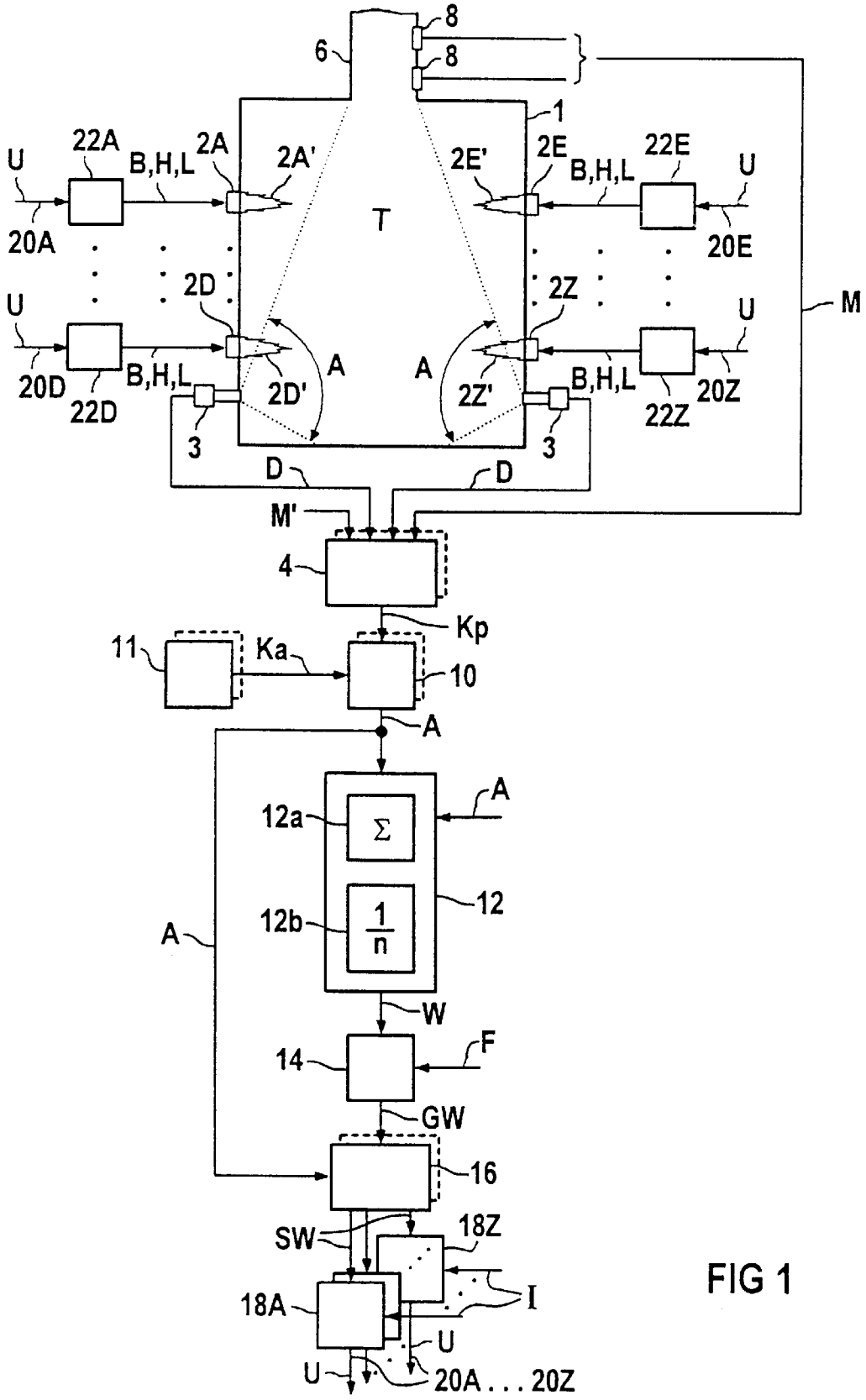
FIG. 1 is a schematic diagram of an apparatus for operating a combustion plant according to the invention.

In all the figures of the drawing, sub-features and integral parts that correspond to one another bear the same reference symbol in each case.

Referring now to the figures of the drawings in detail and first, particularly to FIG. 1 thereof, there is shown a combustion process of a non-illustrated combustion plant, e.g., in a fossil-fired steam generator of a power station or of a garbage incineration plant. The combustion process takes place in a furnace or combustion space 1 having a number of burners 2A to 2Z. Optical sensors 3 in the form of special cameras respectively monitor a section T in the combustion space 1. In the process, for each burner 2A to 2Z, radiation data D from its flame 2A' to 2Z' are recorded respectively in the form of emission spectra. The radiation data D are fed to a measuring module, referred herein as a data processing module 4. The data processing module 4 may be configured, for example, as a fast-response programmable controller and/or as a powerful personal computer.

Temperature distribution and concentration profiles of the reaction products produced during the combustion, such as, for example, NOx, CO, and CH, are calculated from the emission spectra in the data processing module 4 using computer-tomographic reconstruction. Ratio pyrometry determines the temperature and emission spectroscopy determines the concentration of the reaction products or of the combustion radicals.

In addition, measured values M of the respective concentration quantity of the reaction products to be tested are fed to the data processing module 4 from sensors 8 disposed at the outlet of the combustion space 1, in particular, in the flue-gas duct 6. The measured values M of the sensor or of each sensor 8 represent the respective total value or global value of the concentration quantity of one of the reaction products to be recorded. In other words, the measured values M of the sensor or of each sensor 8 describe the concentration quantity of the reaction product at the outlet of the combustion space 1 and, thus, the corresponding pollutant emission.

Further measured values M' are fed to the data processing module 4 through non-illustrated sensors. The further measured values M' characterize, for example, the fuel feed, the air feed of the burner or of each burner 2A to 2Z, or at least one alternating quantity of components that are in heat exchange with one of the burners 2A to 2Z, e.g., another burner 2B to 2Z or the wall of the combustion space 1.

The radiation data D and the measured values M, M' are converted to dynamic characteristic quantities Kp characterizing the combustion process with the data processing module 4 by computer-tomographic reconstruction of the emission spectra or by analog-to-digital conversion. The dynamic characteristic quantities Kp are fed to a combustion analysis module 10.

Furthermore, static characteristic quantities Ka characterizing the combustion plant, e.g. the geometric quantity of the combustion space 1 or the number of burners 2A to 2Z, are fed to the combustion analysis module 10. The static characteristic quantities Ka are stored in a data memory 11, such as, for example, an optical memory or a hard-disk memory. Depending on the type and size of the combustion plant, a plurality of data processing modules 4 and a plurality of combustion analysis modules 10 and data memories 11 may be provided. For example a data processing module 4, a combustion analysis module 10 and a data memory 11 are provided for each burner 2A to 2Z.

The combustion analysis module 10 serves to determine, in a spatially resolved manner, the concentration value of a reaction product, e.g. CO, to be tested in the combustion space 1. In the process, the measured values M, M' converted to the dynamic characteristic quantities Kp are taken into account as global data and the radiation data D are taken into account as spatially resolved data. The geometric ratios of the combustion plant are described by the static characteristic quantities Ka. With reference to the global measured values M, M' and to the spatially resolved radiation data D recorded in a burner-specific manner, the combustion analysis module 10 determines the contribution of each individual burner 2A to 2Z to the respectively tested reaction product.

The spatially resolved radiation data D for the section T of the combustion space 1 are processed with reference to the static characteristic quantities Ka such that, for the reaction product to be tested, the associated concentration profile in the section T is determined in a burner-specific manner. Using a combustion model stored in the combustion analysis module 10, the contribution of an individual burner 2A to 2Z to the reaction product produced in the combustion process is determined in a spatially resolved manner. The dynamic and static characteristic quantities Kp and Ka, respectively fed to the combustion analysis module 10 as input quantities, are processed by the combustion model based on the chemical reaction kinetics.

These input quantities, that is, for example, temperatures, possible compositions, flow velocities, and molecular transport processes occurring during the combustion process, are converted by the combustion model into parameters characterizing the respective operating state of the combustion process. The operating state can include, for example, temperature changes, elementary reactions, diffusions, mass changes, or changes in the enthalpy. The current operating state is taken into account, for example, by differential equations that describe the mass change in the flue gas or the change in the enthalpy due to radiation from the wall of the combustion space 1 or from adjacent burners 2A to 2Z. It is, therefore, possible to draw conclusions about the mode of operation and the operability of each individual burner 2A to 2Z in an especially simple manner.

The combustion analysis module 10 forms with the combustion model an output quantity A for each burner 2A to 2Z from these parameters. The output quantity A represents, in a spatially resolved manner, the proportional value that the corresponding burner 2A to 2Z contributes to the reaction product to be tested. Due to the global, associated value M, M' related to the locally resolved and burner-resolved concentration profile, the output quantity A contains, in particular, information about the contribution of this burner 2A to 2Z to the corresponding emission in the flue-gas duct 6.

Depending on predetermined boundary conditions, the combustion process can be optimized with regard to different parameters. Depending on the type of optimization selected for the combustion, e.g., especially low emission of NO or CO, the combustion model determines as output quantity A the proportional value of the reaction product NO or CO of the corresponding burner 2A to 2Z to be optimized. In particular, the proportional value is determined at the outlet of the combustion space 1.

The output quantity A for each burner 2A to 2Z is then fed to an averaging module 12. The averaging module 12 includes a summer 12*a* and a divider 12*b*. The averaging module 12 determines the average value W of the output quantities A of all the burners 2A to 2Z participating in the combustion process. The output quantities A of all the burners 2A to 2Z are fed to the summer 12*a*. The sum of all the output quantities A is then divided in the divider 12*b* by the number of all the relevant burners 2A to 2Z.

The average value W of the output quantities A that is formed in the averaging module 12 is fed to a weighting module 14. By loading the average value W with a weighting factor F, a weighted average value GW is formed in the weighting module 14 for each burner 2A to 2Z. For example, the contribution of each individual burner 2A to 2Z to the concentration value of the reaction product, in particular, in the flue-gas duct 6, depends on the installation location of the burner 2A to 2Z. The effect of the installation location on the contribution of the burner 2A to 2Z to the total concentration of the reaction product at the outlet of the combustion space 1 is taken into account by the weighting factor F. In addition, the type of optimization of the firing control, e.g., optimization according to NO or CO, also influences the weighting factor F.

The weighted average value GW of each burner 2A to 2Z is then fed to a setpoint module 16. Depending on the type and size of the combustion plant, a plurality of setpoint modules 16, e.g., a setpoint module 16 for each burner 2A to 2Z, may be provided. The output quantity A, delivered by the combustion analysis module 10, of a burner 2A to 2Z to be tested or of a predetermined burner 2A to 2Z, i.e., the proportional concentration value that the corresponding burner 2A to 2Z contributes to the reaction product, is fed to the setpoint module 16.

From the weighted average value GW and the output quantity A, the setpoint module 16 forms at least one setpoint SW for the composition of the fuel mixture B to be fed to the burner 2A to 2Z to be tested. When the setpoint SW is being formed, the contribution of the respective burner 2A to 2Z is, therefore, taken into account through its output quantity A, on one hand, and through the weighted average value GW assigned to it on the other hand.

The respective setpoint SW is fed to an associated controller block 18A to 18Z for forming a number of actuating signals U for the quantity of the respective constituents of the fuel mixture B or for the air feed L or for the dosage of an additional substance H. The respective controller block 18A to 18Z is conventional. A controller block 18A to 18Z is provided for each burner 2A to 2Z. Associated actual values I of the respective burner 2A to 2Z are fed to the controller block 18A to 18Z by non-illustrated sensors or measuring transducers. The respective controller block 18A to 18Z contains all the control loops provided for operation of the combustion plant, e.g., for steaming capacity, excess air, media flow rate, etc., and serves to activate all the actuators influencing the combustion process.

The actuating signal U is fed to a control device 22A to 22Z through an activating line 20A to 20Z. The activation of the actuators of an individual burner 2A to 2Z and, consequently, the addition of the fuel mixture B, of the additional substance H, or of the air feed L is effected by the associated controller block 18A to 18Z. The associated controller block 18A to 18Z is connected to the control device 22A to 22Z through the activating line 20A to 20Z. For testing the burner 2A to 2Z, deviations of the output quantity A from the weighted average value GW are, thus, compensated for by the setpoint SW. Therefore, during such compensation for all the burners 2A to 2Z, the entire combustion behavior of all the burners 2A to 2Z in the combustion space 1 is homogenized.

Figure 2:
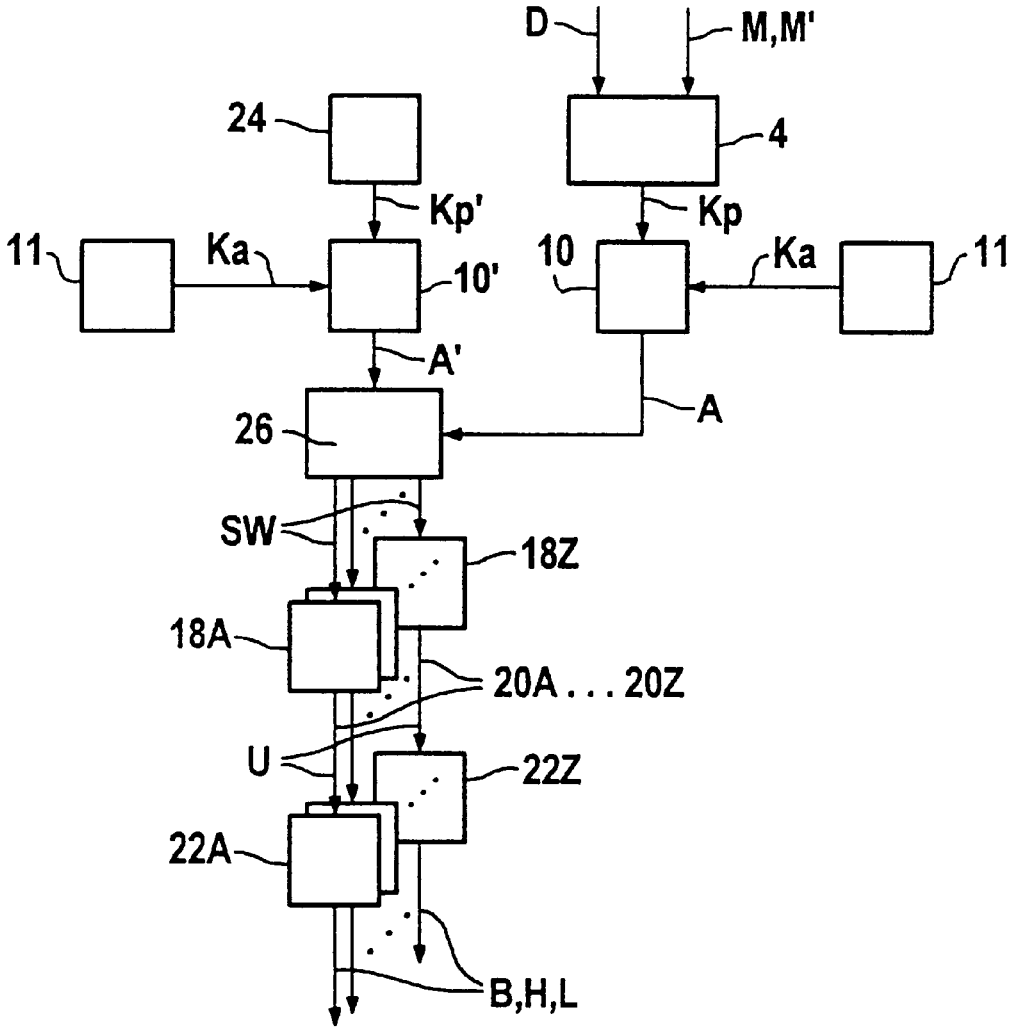
FIG. 2 is a schematic diagram of an alternative embodiment of the apparatus of FIG. 1.

FIG. 2 shows the basic construction of an alternative apparatus for operating a non-illustrated combustion plant. The alternative apparatus has, in addition to the combustion analysis module 10, a further combustion analysis module 10'. Filed dynamic characteristic quantities Kp' of a data module 24 are fed to the further combustion analysis module 10'. The combustion analysis module 10' is identical to the combustion analysis module 10 already described above with one exception. The exception lies in the type of characteristic quantities Kp' that are fed as input quantities to the combustion analysis module 10' in addition to the static characteristic quantities Ka characterizing the combustion plant.

The combustion model stored in the combustion analysis module 10' determines an output quantity A' for each burner 2A to 2Z with reference to the stored dynamic characteristic quantities Kp' and the static characteristic quantities Ka. The output quantity A' characterizes a burner-resolved and spatially resolved concentration value at a reaction product to be tested for the respective burner 2A to 2Z. The resolved concentration value has represented an especially favorable operating behavior of this burner 2A to 2Z in the past. The output quantity A' based on stored characteristic quantities Kp' is then compared in a comparison module 26 with the currently determined output quantity A of the same burner 2A to 2Z.

As stored output quantity A', the concentration value that achieved an especially low emission and homogeneous combustion is preferably always used for the comparison of the concentration value. If the output quantity A determined by the current characteristic quantities Kp and Ka is poorer with regard to the emissions than the output quantity A' representing an optimum and filed last, the filed output quantity A' is used for forming the setpoints SW for the control. On the other hand, if the currently determined output quantity A represents a better result for the formation of the setpoints SW compared with the filed output quantity A', these characteristic quantities Kp are stored as new characteristic quantities Kp', representing optimum combustion, in the data module 24.

Therefore, the comparison module 26 forms setpoints SW that, similar to the method described with reference to FIG. 1, are converted by the respective controller block 18A to 18Z into actuating signals U for the quantity of the respective constituents of the respective fuel mixture B or for the air feed L or for the dosage of an additional substance H of the relevant burner 2A to 2Z. The respective controller block 18A to 18Z is connected to the control device 22A to 22Z of the actuators through the associated activating line 20A to 20Z for activating the actuators.

The number of data processing modules 4, data modules 24, combustion analysis modules 10, 10', and setpoint or comparison modules 16 or 26, respectively, may vary. For example, a separate data processing module 4, a separate data module 24, a separate combustion analysis module 10, 10', and a separate setpoint or comparison module 16 or 26, respectively, may be provided for each burner 2A to 2Z, i.e., in a burner-resolved manner. Alternatively, a common data processing module 4, a common data module 24, a common combustion analysis module 10, 10', and a common setpoint or comparison module 16 or 26, respectively, may be provided for all the burners 2A to 2Z.

In addition, the burner analysis constructed from the data module 24 and the combustion analysis module 10' and designated as flue-gas trace may be connected off-line and, thus, parallel to the on-line burner analysis constructed from the data processing module 4 and the combustion analysis module 10. Then, the burner analysis connected off-line permits the simulation of the combustion process, in which case the characteristic quantities Kp' stored as input quantities or measured quantities may be varied in the data module 24 by small amounts until an output quantity A' representing an especially low emission is determined. The optimized output quantity A' is then used as input for the comparison module 26.

The above-described apparatus for operating a combustion plant achieves homogeneous combustion in the combustion space 1 with an especially low pollutant emission. It is achieved, in particular, by the optimized combustion behavior of each burner 2A to 2Z with regard to the respective contribution to the total emission determined of a pollutant or reaction product to be optimized.

We claim:

1. A method of operating a combustion plant having a number of burners, which comprises:

controlling a composition of a fuel mixture of each burner with at least one setpoint for each individual burner determined with reference to dynamic characteristic quantities characterizing a combustion process; and determining the at least one setpoint in dependence on a contribution of each individual burner to a total proportion of a reaction product produced in the combustion process, the contribution of each burner to a concentration quantity of the reaction product produced in the combustion process being determined for each burner with reference to the dynamic characteristic quantities and static characteristic quantities characterizing the combustion plant.

2. The method according to claim 1, wherein the determining step comprises determining the contribution of each burner to the reaction product using spatial resolution.

3. The method according to claim 1, which further comprises processing at least one of the dynamic and static characteristic quantities with a combustion model of the combustion process.

4. The method according to claim 3, wherein the processing step comprises simulating chemical reaction kinetics with the combustion model of the combustion process.

5. The method according to claim 1, wherein the determining step comprises determining at least some of the dynamic characteristic quantities with measurements.

6. The method according to claim 1, which further comprises outputting at least some of the dynamic characteristic quantities from a memory as filed characteristic quantities.

7. The method according to claim 1, wherein the dynamic characteristic quantities of the combustion process include at least one of a concentration value of a reaction product in a flame of a selected burner, a quantity of fuel fed to the selected burner, a quantity of air fed to the selected burner, and at least one alternating quantity of components that are in heat exchange with the selected burner.

8. The method according to claim 1, wherein the static characteristic quantities of the combustion plant include at least one of a number of burners used and at least one geometric quantity of a combustion space.

9. The method according to claim 1, which further comprises processing at least one of the static and the dynamic characteristic quantities with a combustion model of the combustion process to form an output quantity characterizing an individual/respective burner.

10. The method according to claim 9, wherein the processing step comprises comparing the output quantity characterizing the respective burner with a weighted average value of output quantities characterizing burners other than the respective burner, and using the resulting comparison value to form a setpoint for the respective burner.

11. An apparatus for operating a combustion plant having burners, the apparatus comprising:

a setpoint module for determining at least one setpoint for each individual burner of the burners in dependence on the contribution of the individual burner to a total proportion of a reaction product produced in the combustion process, the burners respectively controlled with the at least one setpoint for a composition of a fuel mixture, the at least one setpoint being determined with reference to dynamic characteristic quantities characterizing a combustion process; and at least one combustion analysis module for processing the dynamic characteristic quantities and static combustion quantities characterizing the combustion plant, said at least one combustion analysis module connected to and upstream of said setpoint module in a signal flow direction directed from said setpoint module to said at least one combustion analysis module in order to determine the contribution of each individual burner.

12. The apparatus according to claim 11, further comprising a data processing module for determining the dynamic characteristic quantities of each burner of the burners, said data processing module being connected upstream of said at least one combustion analysis module in a signal flow direction directed from said at least one combustion analysis module to said data processing module.

13. The apparatus according to claim 11, wherein said combustion analysis module is two combustion analysis modules and including a data module for filed dynamic characteristic quantities, said data module being connected upstream of at least one of said two combustion analysis modules in a signal flow direction directed from at least one of said two combustion analysis modules to said data module.

14. The apparatus according to claim 13, wherein said data module is connected upstream of a second of said two combustion analysis modules in a signal flow direction directed from said second of said two combustion analysis modules to said data module.

15. The apparatus according to claim 11, further comprising a data memory for filing static characteristic quantities characterizing the combustion plant, said data memory connected to said at least one combustion analysis module.

16. The apparatus according to claim 11, wherein said at least one combustion analysis module has a combustion model.

17. The apparatus according to claim 11, further comprising at least one of an averaging module and a weighting module, said setpoint module being connected to said at least one combustion analysis module with said at least one of said averaging module and said weighting module in between.

18. The apparatus according to claim 11, further comprising an averaging module, said setpoint module being connected to said at least one combustion analysis module with said averaging module in between.

19. The apparatus according to claim 11, further comprising a weighting module, said setpoint module being connected to said at least one combustion analysis module with said weighting module in between.

20. The apparatus according to claim 11, further comprising an averaging module and a weighting module, said setpoint module being connected to said at least one combustion analysis module with said averaging module and said weighting module in between, said averaging model being disposed upstream of said weighting module in a signal flow direction directed from said weighting module to said averaging module.

* * * * *